US006354358B1

(12) United States Patent
Ishida

(10) Patent No.: US 6,354,358 B1
(45) Date of Patent: Mar. 12, 2002

(54) CONTINUOUS CASTING MOLD WITH TUNGSTEN ALLOY PLATING AND METHOD OF PRODUCING THE SAME

(75) Inventor: Kohei Ishida, Osaka (JP)

(73) Assignee: Nomura Plating Co., Ltd., Osaka (JP)

( * ) Notice: Subject to any disclaimer, the term of this patent is extended or adjusted under 35 U.S.C. 154(b) by 0 days.

(21) Appl. No.: 09/717,348

(22) Filed: Nov. 22, 2000

(30) Foreign Application Priority Data

Nov. 26, 1999 (JP) ..... 11-336692

(51) Int. Cl.[7] ..... B22C 3/00; B22D 11/00; C25D 5/02; C25D 3/56

(52) U.S. Cl. ..... 164/72; 164/138; 164/418; 205/122; 205/259; 205/261; 205/238

(58) Field of Search ..... 164/72, 75, 459, 164/418; 205/80, 122, 259, 261, 238

(56) References Cited

U.S. PATENT DOCUMENTS 4,197,902 A * 4/1980 Von Jan et al. ..... 164/418

FOREIGN PATENT DOCUMENTS

| | | | |
|---|---|---|---|
| JP | 52-50734 | | 12/1977 |
| JP | 58-23822 | | 5/1983 |
| JP | 58-25534 | | 5/1983 |
| JP | 58-41933 | | 9/1983 |
| JP | 58-41934 | | 9/1983 |
| JP | 58-41936 | | 9/1983 |
| JP | 58041934 A | * | 9/1983 |
| JP | 58-212840 | | 12/1983 |
| JP | 358212840 A | * | 12/1983 |
| JP | 60-135592 | | 7/1985 |
| JP | 60-39453 | | 9/1985 |
| JP | 61-15782 | | 4/1986 |
| JP | 3-69995 | | 11/1991 |
| JP | 4-38838 | | 6/1992 |
| JP | 7-310196 | | 11/1995 |
| JP | 407310196 A | * | 11/1995 |
| JP | 11-229176 | | 8/1999 |
| JP | 411229176 A | * | 8/1999 |

* cited by examiner

*Primary Examiner*—M. Alexandra Elve
*Assistant Examiner*—Kevin McHenry
(74) *Attorney, Agent, or Firm*—Wenderoth, Lind & Ponack, L.L.P.

(57) ABSTRACT

To provide a novel casting mold for use in continuous casting, which has long life and excellent heat resistance, yet capable of completely preventing corrosion, which frequently occurs on the lower portion of the casting mold.

A continuous casting mold for steel made from copper or a copper alloy, wherein said casting mold comprises a plane in contact with molten steel partly or wholly covered with a tungsten alloy plating containing either or both of nickel and cobalt, and said plating containing tungsten carbide forming a solid solution therewith. To produce the casting mold above, there is used a plating solution containing either or both of a nickel salt and a cobalt salt and a tungstate, together with at least one selected from an oxycarboxylic acid and salts thereof, and at least one type of an organic compound and salts thereof having two or less of carbon atoms within the molecule, provided that its oxidation decomposition potential is lower than that of the oxycarboxylic acid or a salt thereof.

8 Claims, 4 Drawing Sheets

6. Copper or copper alloy
7. Tungsten alloy containing tungsten carbide
8. Nickel or nickel iron alloy The content of carbon and the amount of formic acid or its salt added Hardness of various coatings 1. Nickel plating
2. Nickel - 7% iron alloy plating
3. Thermal sprayed nickel-chromium
4. Nickel (from solution B)-
   30% tungsten alloy plating/test piece B
5. Nickel (from solution A)-
   30% tungsten alloy plating/test piece A Heating temperature and wear volume 1. Nickel plating
2. Nickel - 7% iron alloy plating
3. Thermal sprayed nickel-chromium
4. Nickel (from solution B)-
   30% tungsten alloy plating/test piece B
5. Nickel (from solution A)-
   30% tungsten alloy plating/test piece A 6. Copper or copper alloy
7. Tungsten alloy containing tungsten carbide
8. Nickel or nickel iron alloy

CONTINUOUS CASTING MOLD WITH TUNGSTEN ALLOY PLATING AND METHOD OF PRODUCING THE SAME

BACKGROUND OF THE INVENTION

1. Field of the Invention

The present invention relates to a casting mold for use in continuous casting, which is a so-called casting mold for use in continuous casting of steel in which a molten steel passed through a converter from a smelting furnace is made into a steel. The casting mold of the present invention is made from copper or an copper alloy, whose surface in contact with the molten steel is partly or wholly covered with a coating of a hard metal having not only a high wearing resistance but also a high corrosion resistance i.e., an alloy containing nickel or cobalt, or both together with tungsten, provided that a part of tungsten is incorporated in the form of tungsten carbide.

2. Description of the Prior Art

Conventionally, when a casting mold f or use in continuous casting made from copper or an copper alloy was used as it in the casting, there occurred not only the wear loss of copper, but also damages attributed to the direct collision and the like. Moreover, there was, a disadvantage of forming surface defects denoted as "star cracks" on the bottom of the casting mold due to the scratches that were formed by the direct contact with the surface-solidified ingots. In the light of such circumstances, in order to prolong the life of the casting mold by preventing damages, or to improve the quality of the ingot, there were proposed, for instance, providing a nickel plating or a nickel-iron alloy plating, or providing a three-layered coating comprising nickel-phosphorus alloy layer and a chrome plating on nickel, on the plane, with which the steel melt contacts, of the casting mold made of copper or copper alloy (see JP-B-Sho52-50734, the term "JP-B" as referred herein signifies "an examined published Japanese Patent Application"). Although these proposals were effective to some extent, however, with changing casting conditions, such as an increase in speed of drawing the ingots during casting, an improvement in the powder for use in casting, or the application of an electromagnetic induction stirring, etc., there newly occurred other problems such as the shortening of life due to the problematic generation of corrosion at the bottom portion of the casting mold and due to the increase in the casting speed. Thus, at present, coating materials for casting molds having longer life and further improved in resistances against heat and corrosion are demanded.

As a casting mold meeting such demands, there is proposed a casting mold covered with a thermal sprayed self-fluxing nickel-chromium alloy (see JP-B-Sho60-39453 and 20 JP-B-Sho61-15782). However, in order to achieve high strength and excellent adhesion of the coating with the base material, they require a high temperature thermal treatment to be performed at a temperature as high as 1,000° C. in an oxidation preventive atmosphere, and this further requires the use of a precipitation hardened type copper as the copper material to be used for the casting mold. Still, however, the problems of causing degradation and the deformation on the copper material are unavoidable. Furthermore, there are problems of peeling off or of accidents attributed to the dropping of the thermal sprayed coatings. Accordingly, in practice, the application of the methods above is limited to the short edge (narrow plane) of the casting mold for slabs having a smaller area. Furthermore, although there is used a corrosion-resistant material such as nickel-chromium, there still are found corrosion troubles in part of the casting molds.

As a method other than thermal spraying, many proposals have long been made on the so-called composite plating, in which various types of ceramics having lubricating properties and high hardness, such as boron nitride, molybdenum sulfide, silicon carbide, alumina, etc., are dispersed and co-precipitated in a matrix of nickel, cobalt, a nickel-phosphorus alloy or a cobalt-phosphorus alloy, or a nickel-boron alloy, etc. For instance, representative examples can be found in JP-B-Sho58-41933, JP-B-Sho58-23822, JP-B-Sho58-41934, JP-B-Sho58-25534, JP-B-Sho58-41936. In practice, however, those known as dispersion or composite plating tend to cause permanent corrosion on the matrix side due to not only the insufficient junction of the dispersed material and the matrix, but also the difference in potential between the metal of the matrix and the dispersed material. Accordingly, even if the dispersion or the composite plating should exhibit excellent lubricity or wear resistance under the ordinary conditions, it suffers corrosion troubles in the early stage of their practical use due to the specific casting atmosphere, and it cannot fully accomplish its life.

Furthermore, in JP-A-Sho58-212840 (the term "JP-A" as referred herein signifies "an unexamined published Japanese Patent Application") is proposed a casting mold for use in casting. which is covered with tungsten alloydized with nickel. However, on following the process disclosed therein, it was found that the electroplating solution or liquid undergoes decomposition and degradation in a very short period of time, and in case of applying this casting mold in continuous casting, it was found that not only the quality of the alloy cannot be maintained, but the solution or liquid must be newly prepared. Thus, this led to a great waste of economically expensive tungsten salts and nickel salts. Further, the method disclosed in JP-A-Hei7-310196, the plating method comprising dispersing silicon carbide as disclosed in JP-B-Hei4-38838, or the methods disclosed in JP-B-Hei3-69995 or JP-A-Sho60-135592, etc., had the same great problems concerning the stability of the electroplating solution or liquid, and in fact, there is known no practical application thereof to casting mold inclusive of continuous casting.

SUMMARY OF THE INVENTION

An object of the present invention is to provide a novel continuous casting mold (i.e. a novel casting mold for use in continuous casting), which can accomplish the requirements for improved life and heat resistance in comparison with any type of recent casting mold for continuous casting, and which can completely prevent the frequently occurring corrosion on the lower portion of the casting mold. Thus, the present inventors have paid attention to an alloy based on tungsten, which had been conventionally considered to possess resistances against heat and wear, but which was never brought into practical use as a coating material for a continuous casting mold, due to the instability of the electroplating solution. As a result of intensive study by the present inventors, it is enabled to solve the aforementioned problems of the instability of the electroplating solution, and as an additional effect, and it is enabled to provide a casting mold for use in continuous casting having longer life, having high resistance against scratches, and yet having excellent heat resistance and capable of realizing high corrosion resistance under the casting atmosphere.

The present invention relates to:

(i) A casting mold for use in continuous casting of steel made from copper or a copper alloy, wherein said casting mold comprises a surface in contact with molten steel partly or wholly covered with a tungsten alloy plating containing either or both of nickel and cobalt, and said plating further containing tungsten carbide in the tungsten alloy.

(ii) A casting mold for use in continuous casting as described in (i), wherein the alloy contains from 0 to 60% by weight of cobalt and from 1 to 40% by weight of tungsten as the components of an alloy with nickel, and the plating is provided at a thickness of from 0.10 to 2.00 mm.

(iii) A casting mold for use in continuous casting as described in (i) or (ii), wherein a nickel or a nickel-iron alloy coating is provided between said alloy plating as described in (i) and the casting mold body made from copper or a copper alloy.

(iv) A method for producing a casting mold for use in continuous casting of steel made from copper or a copper alloy, comprising a surface in contact with molten steel partly or wholly covered with a tungsten alloy plating containing either or both of nickel and cobalt, and said plating further containing tungsten carbide in the tungsten alloy, which comprises electroplating, either partly or wholly, the surface of said casting mold to be brought into contact with a molten steel in a plating solution containing either or both of a nickel salt and a cobalt salt and a tungstate, together with at least one selected from an oxycarboxylic acid and salts thereof, and at least one type of an organic compound and a salt thereof having two or less of carbon atoms within the molecule, provided that its oxidation decomposition potential is lower than that of the oxycarboxylic acid or a salt thereof.

(v) A method for producing a casting mold for use in continuous casting as described in (iv), wherein the oxycarboxylic acid is citric acid, tartaric acid, or an ammonium salt, a sodium salt, or a potassium salt thereof; and the organic compound and a salt thereof having two or less of carbon atoms within the molecule, which is potentially lower than that of the oxycarboxylic acid, is selected from the group consisting of methanol, formaldehyde, formic acid, ammonium formate, nickel formate, sodium formate, oxalic acid, ammonium oxalate, potassium oxalate, etc., and (vi) A method for producing a casting mold for use in continuous casting as described in (iv) or in (v), wherein the electroplating solution contains an oxycarboxylic acid or a salt thereof at a concentration of 0.5 times or higher of the molar concentration of the total concentration of nickel, cobalt, and tungsten, and contains the organic compound having two or less carbon atoms within the molecule or a salt thereof at a molar concentration of 0.1 to 3.0.

BRIEF DESCRIPTION OF THE DRAWINGS

FIG. 1 is a diagram showing the relation between the content of carbon contained in the inner coating of a casting mold for use in continuous casting according to the present invention and the amount of formic acid added to the plating solution.

FIG. 2 is a diagram showing the relation between heating temperature and the Vicker's hardness of the inner coating of a casting mold for use in continuous casting according to the present invention as well as various other coatings.

FIG. 3 is a diagram showing the relation between the heating temperature and the wear volume of the inner coating of a casting mold for use in continuous casting according to the present invention as well as various other coatings.

FIG. 4 is a cross section view of an inner coating of a casting mold for use in continuous casting according to the present invention.

EXPLANATION OF REFERENCE LETTERS OR NUMERALS

6 Copper or copper alloy

7 Tungsten alloy containing tungsten carbide

8 Nickel or nickel iron alloy

DETAILED DESCRIPTION OF THE INVENTION

Figure 1:
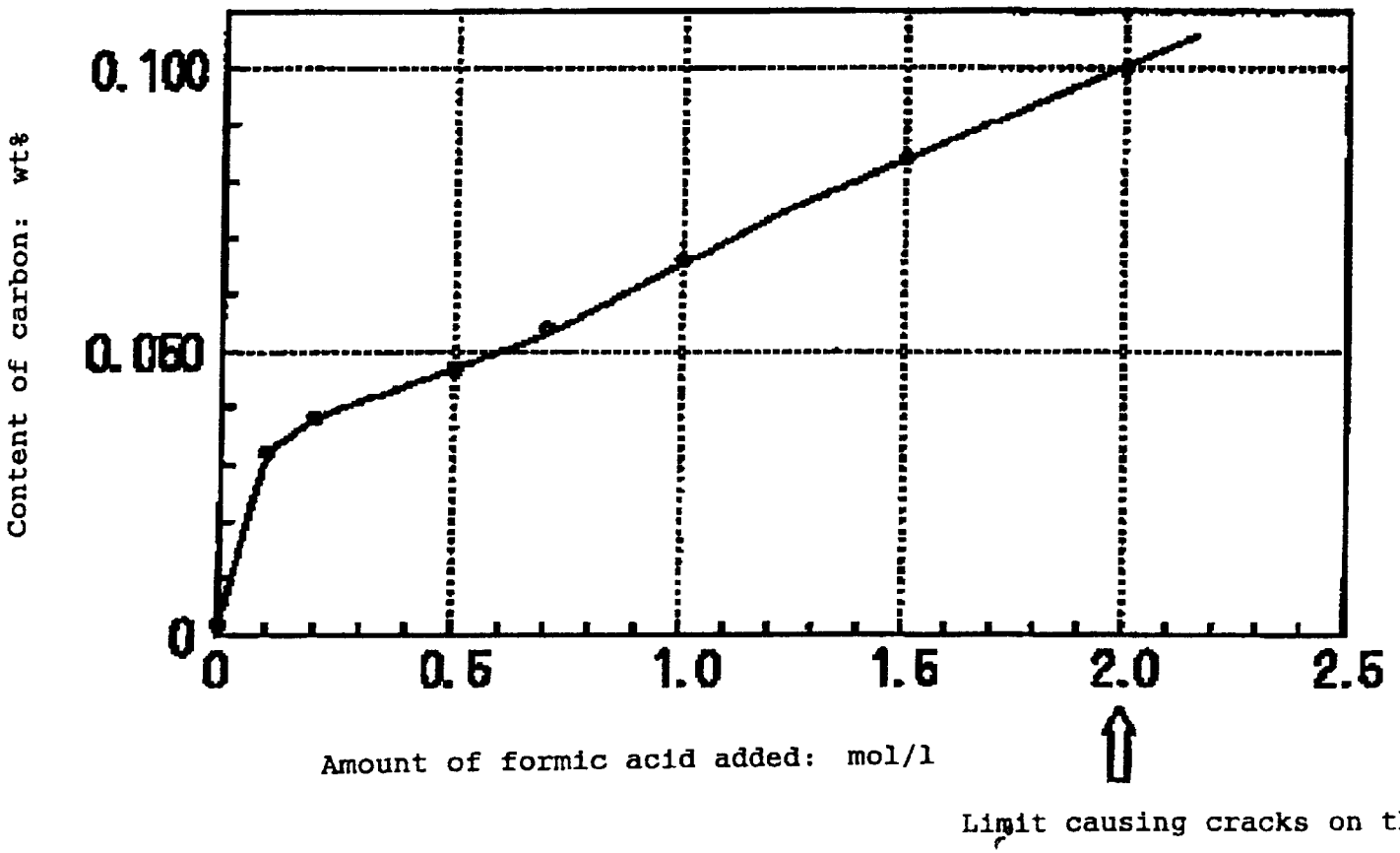
FIG. 1.

It is known that, in general, tungsten itself cannot be used in electroplating in the form of an aqueous solution. It is also well known, however, that when used in electroplating in the presence of a metallic ion such as of nickel, an alloy of nickel and tungsten is obtainable. As a means for obtaining a nickel-tungsten alloy, there are numerous reports on obtaining a nickel-tungsten alloy by performing electroplating using a plating solution comprising a nickel salt and a tungstate salt, in which are added a citric acid, tartaric acid, etc. In case of plating an alloy of nickel and tungsten by using such solutions, the liquid undergoes decomposition within a several hours after applying the current for plating, and the physical properties of the plated nickel-tungsten alloy changes with time, thereby making it unfeasible to be used as a coating material of continuous casting mold, in which high heat resistance, wear resistance, and corrosion resistance are required. Accordingly, the present inventors first began to improve the stability of the plating solution.

The reason why the solution changes with time resides in the fact that tungsten and nickel cannot remain stably in the solution, because the oxycarboxylic acid including citric acid, tartaric acid or a salt thereof, whose function is to stabilize nickel and tungsten in the solution by forming chelates thereof, is subjected to anodic oxidation during the process of electroplating, and thereby undergoes decomposition and forms complicated products due to electrolysis. That is, the key for successfully accomplishing the object above is how to stably maintain the solution without causing anodic oxidation of the chelating agents, i.e., the oxycarboxylic acid or the salts thereof whose function is to stably maintain the solution. Concerning this point, certain types of organic compounds containing two or less carbon atoms or the salts thereof, e.g., formic acid added at a certain concentration or higher, were found to stably maintain the oxycarboxylic acids and the salts thereof, while the organic compounds or salts thereof undergo anodic oxidation sacrificially and generate harmless gaseous carbon dioxide, because they are potentially lower than the oxycarboxylic acids or the salts thereof (see JP-A-Hei11-229176). At the same time, in case of a nickel-tungsten alloy, a part of carbon is incorporated into the coating as to form carbides and form a solid solution with the matrix. Thus, it has been found that the coating thus obtained not only resists to an electrolytic process for a long duration of time in case it is applied to a casting mold for use in continuous casting, but also, as an additional effect, can form a coating material having an alloy layer containing carbides on the continuous casting mold. Furthermore, as compared with any type of casting molds coated with conventional coating materials, it was also found that the casting mold for continuous casting according to the present invention has far improved wear resistance, heat resistance, and corrosion resistance.

More specifically, the solution containing a tungstate salt together with either or both of a nickel salt and a cobalt salt, to which an oxycarboxylic acid or a salt thereof, e.g., citric acid, trisodium citrate, diammonium citrate, tartaric acid, sodium tartarate, etc;, which functions as such to form a chelate of the metallic components of the salts thereof, is added. The oxycarboxylic acid is almost the same as those known in the art. However, the point is that an organic compound containing two or less carbon atoms within the molecule (referred to hereinafter as "the stabilizing agent") is fiber used, provided that the anodic oxidation potential of the organic compound is lower that of the oxycarboxylic acid or the salt thereof. As the stabilizing agent, specifically mentioned are formic acid, nickel formate, ammonium formate, sodium formate, or those which finally yields formic acid , such as methanol, formaldehyde, or oxalic acid. Furthermore, these stabilizing agents are used at a certain concentration or higher. In his manner, the oxycarboxylic acid or the salt thereof can be maintained stably in the solution during the electrolytic process, while providing a coating of nickel-tungsten alloy, cobalt-tungsten alloy, or a ternary alloy such as nickel-cobalt-tungsten, etc., with carbides incorporated simultaneously in the coating. In this case, the important point is that carbon does not react with nickel or cobalt, but that it undergoes reaction with a part of tungsten so as to form tungsten carbide. The above carbon seems to come from the carboxylic acid or the organic compound. This has been found as the reason for highly improving the resistance against wear and the hardness at high temperatures.

Furthermore, concerning the concentration of the stabilizer necessary for the stabilization of oxycarboxylic acid, it is found through the experiments that a concentration of 0.01 molar concentration or higher is sufficient. However, in order to effectively improve the properties of the tungsten alloy by positively forming tungsten carbide, a concentration of 0.1 molar concentration or higher is necessary, and the upper limit of the concentration is known to be 3.0 molar concentration. If the stabilizer is added too excessively, it causes cracks on the coating or generates coating defects such as pinholes due to an increase in viscosity of the solution. Accordingly, a preferred amount of the stabilizer is set in a concentration range of from 0.2 to 2.0 molar concentration. As a result, the amount of carbon that undergoes reaction with tungsten falls in a range of from 0.01 to 0.15 wt %. Furthermore, it has been found that the use of formic acid and a salt thereof particularly brings about preferred results.

In FIG. 1 is shown the results of chemical analysis for carbon, the analysis being performed on the coating, in case nickel-30% tungsten alloy coating was plated by using a plating solution containing 0.3 molar concentration of nickel sulfate, 0.3 molar concentration of sodium tungstate, and 0.6 molar concentration of diammonium citrate, while changing the addition of formic acid in a range of from 0 to 3 molar concentration and adjusting a pH value by using ammonia. The analysis was performed by using combustion method and ESCA (i.e. X-ray Photoelectro Spectro Analyzer), and the formation of carbides was also confirmed by comparing the analytical results thus obtained. Furthermore, on performing the same analysis except for using cobalt sulfate in the place of nickel sulfate at the same concentration, or on performing the same analysis except that in this analysis a mixture of nickel sulfate and cobalt sulfate each at a concentration of 0.15 molar concentration was used, it was found that similar results can be obtained.

Separately, the amount of an oxycarboxylic acid or a salt thereof (i.e., the chelating agent) necessary for a known plating solution capable of providing an alloy containing tungsten and nickel or cobalt, or both, was determined by taking the stability of the solution into account. As a result, it has been found that the necessary amount of oxycarboxylic acid or its salt is 0.5 times or higher than the total molar number of the metals, preferably, equimolar amount or higher. If this condition should be satisfied, not only the stabilizer effectively functions to all of the known plating solutions as to considerably improve the stability of the plating solution, but also the coprecipitated carbon undergoes reaction with a part of tungsten as to realize a continuous casting mold coated with a tungsten alloy containing tungsten carbide in the matrix. However, if the alloydizing ratio of tungsten should exceed 40%, any of the alloys of the metals tend to become brittle and easily breakable. If the ratio should be too small, the synergetic effect of tungsten carbide with tungsten cannot be obtained. Accordingly, the effective amount of tungsten incorporated in the alloy is in a range of from 1 to 40 wt %. By the way, the percentage throughout the specification is on the weight basis unless otherwise noted.

As described above and in the following examples, by using a plating solution containing ① either or both of a nickel salt and a cobalt salt and ② a tungstate, and ③ an oxycarboxylic acid or a salt thereof together with ④ an organic compound such as formic acid, formate, formaldehyde, methanol, oxalic acid, oxalate and so on having two or less of carbon atoms within the molecule and having lower potential than the oxycarboxylic acid or a salt thereof, the oxycarboxylic acid or a salt thereof can be stably maintained in the solution during the plating process, while tungsten carbide is simultaneously formed from part of the tungsten incorporated therein. Thus, a continuous casting mold for steel making using the coating deposited from the plating solution above exhibits high hardness at higher temperatures as well as excellent corrosion and wear resistances never achieved to present. Furthermore, since the plating solution need not be replenished, the process can be carried out extremely economically, and, because the coating is formed electrochemically, there occurs no such problems found in the conventional casting molds produced by thermal spraying, i.e., the damages of the copper material or accidental peeling off of due to the exposure to high temperatures.

The stability of the solution for coating an alloy of nickel or cobalt with tungsten, or a ternary alloy of nickel, cobalt, and tungsten, which contains tungsten carbide, according to the present invention, as well as the performance of the coating obtained therefrom, is described below by referring to examples.

EXAMPLES

Example 1

A plating solution of nickel-tungsten alloy containing 0.2 mol concentration of nickel sulfate, 0.2 molar concentration of sodium tungstate, 0.4 molar concentration of trisodium citrate, and 0.5 molar concentration of sodium formate was prepared, and was adjusted to a pH value of 6.5 by using aqueous ammonia. The solution thus prepared is denoted as solution A. Separately, a solution similar to solution A was prepared except for omitting sodium formate, and was denoted as solution B. Then, on one side of a test piece of chrome-zirconium-copper alloy 100 mm in width, 100 mm in length, and 10 mm in thickness, electrolysis was applied by the use of solution A or solution B, respectively, at 70° C. at a current density of 10 A/dm$^2$ for a duration of 20 hours by using three electrodes, i.e., of nickel, tungsten, and stainless steel, as the counter electrode. The nickel-tungsten alloy deposit thus obtained were each 1 mm in thickness. However, although the plating obtained from solution B had rough surface, that obtained from solution A all exhibited semi-bright and smooth surfaces. Furthermore, although solution A maintained its original color tone throughout the electrolysis for a duration of 20 hours, solution B was found to generate clouding in the solution after a passage of 2 hours, and deposits were found to be completely developed after 8 hours in the solution.

Figure 2:
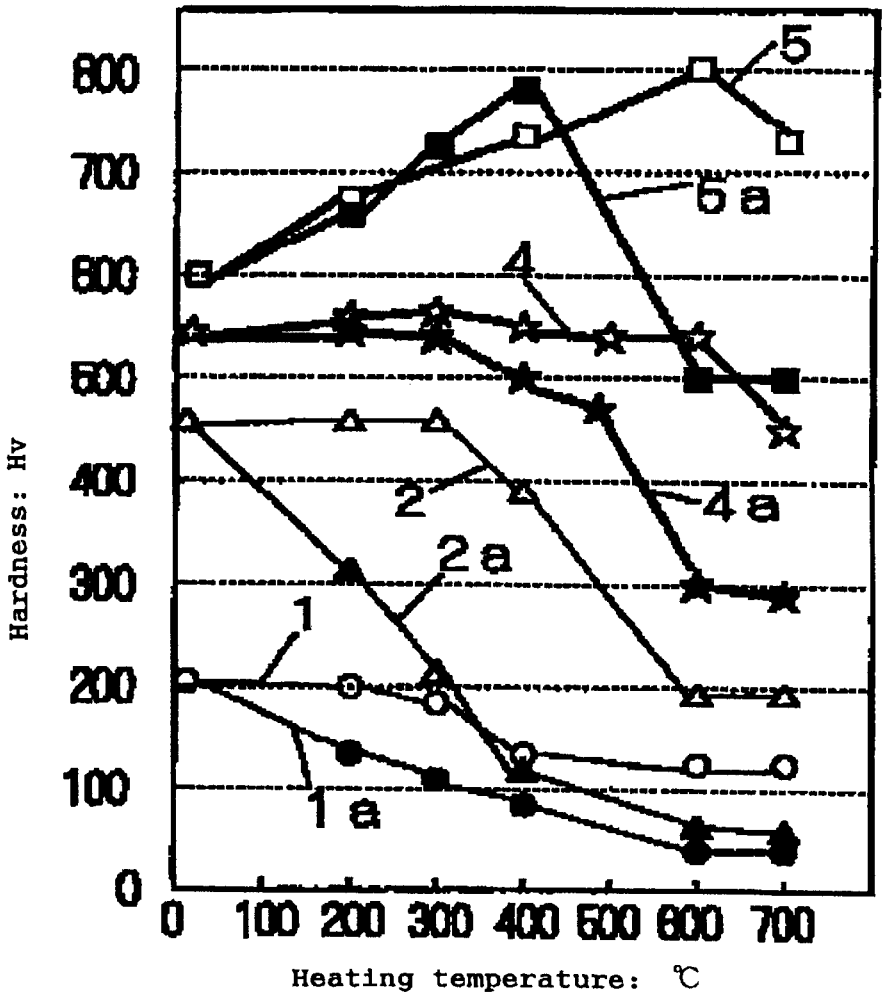
FIG. 2.
Figure 3:
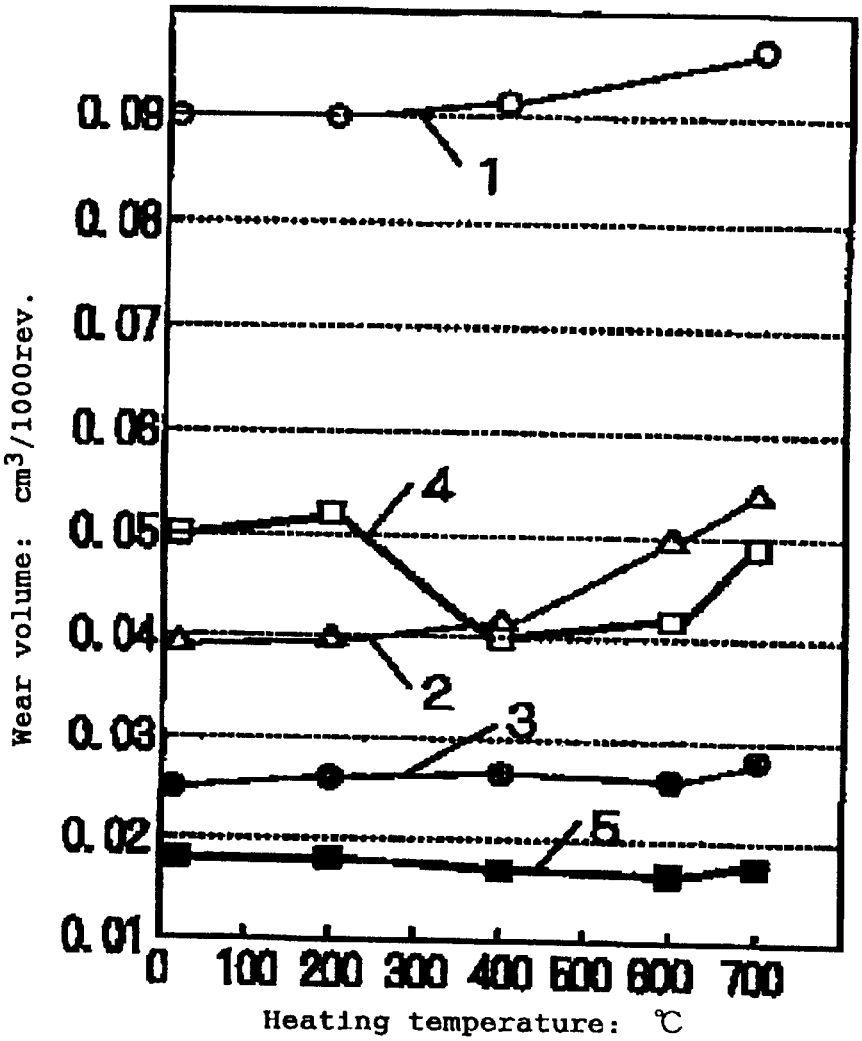
FIG. 3.

The samples prepared from solutions A and B were each denoted as test pieces A and B, respectively, and the hardness, the change with heating, and the wear resistance were compared with other representative coatings used in casting molds for continuous casting. The results are shown in FIG. 2 and FIG. 3. In the figures, numeral 1 corresponds to the properties of a nickel plating, 2 corresponds to a nickel-7% iron plating, 3 corresponds to a thermal sprayed nickel-chromium alloy coating, 4 corresponds to a nickel-30% tungsten alloy plating obtained from solution B (test piece B), and 5 corresponds to a nickel-30% tungsten alloy plating obtained from solution A (test piece A). In FIG. 2, the solid symbols 1*a*, 2*a*, 4*a*, and 5*a* each show the hot hardness, and the open symbols 1, 2, 4, and 5 each show the hardness after having a thermal history of 1 hour.

From FIG. 2 and FIG. 3, it can be clearly understood that the nickel-tungsten alloy (test piece A) which is used a formate for a proper amount as the stabilizer shows extremely excellent properties. This is presumed as the effect of formate which not only stabilizes citrate, but, and at the same time, forms carbides with tungsten during its own decomposition process. On quantitatively analyzing the test pieces A and B by means of EPMA (i.e. Electron Probe Microanalyzer), the amount of tungsten incorporated were found to be 31.1 wt % and 30.5 wt %, respectively, and there was no great difference between the values. Furthermore, the presence of carbides was detected by means of ESCA (i.e. X-ray Photoelectron Spectro Analyzer), and 0.048 wt % of bonded carbon was found on test piece A, whereas only a contaminant carbon was detected on test piece B. The amount of citrate in the solution before and after performing plating was obtained by ion chromatography. As a result, the concentration of citrate in solution A changed from 0.21 molar concentration to 0.20 molar concentration, whereas that in solution B changed from 0.22 molar concentration to 0.12 molar concentration.

Example 2

In Table 1 are shown the examples obtained by first preparing a plating solution containing a nickel salt, a cobalt salt, a tungstate, a citrate, and a stabilizing agent each incorporated in proper amounts, and then coating a copper alloy containing chromium and zirconium in a manner similar to Example 1 as to obtain a tungsten alloy coating having a targeted thickness of 0.5 mm and containing tungsten carbide forming a solid solution therewith. The table shows that all of the samples yield high hardness and high wear resistance. In Table 1, the wear volume obtained by Flat Disk Revolution Wear Resistance Tester (Taber abrasion tester) shows the wear volume obtained at the condition of each 1,000 revolutions, while applying a load of 1 kg and using friction ring H-10 (a wear test ring H-10). The value given in the table is a mean value obtained for 5 times of runs.

TABLE 1

Plating solution for coating various types of tungsten alloys containing tungsten carbide and the properties of the coatings

| No. | Composition and conditions of plating solution | Hardness: Hv | | | Wear volume by Flat Disk Revolution Wear Resistance Tester: cm$^2$ | | | W: wt % Co: wt % | C: wt % |
|---|---|---|---|---|---|---|---|---|---|
| | | As plated | 400° C. × 1 hr | 700° C. × 1 hr | As plated | 400° C. × 1 hr | 700° C. × 1 hr | | |
| 1 | Nickel sulfate (hexahydrate): 0.2 mol<br>Sodium tungstate: 0.2 mol<br>Ammonium citrate: 0.4 mol<br>Ammonium formate: 1.0 mol<br>pH: 6.5<br>temperature: 70° C. | 854 | 782 | 753 | 0.016 | 0.014 | 0.017 | 33.1 | 0.088 |
| 2 | Colbalt sulfate (heptahydrate): 0.2 mol<br>Sodium tungstate: 0.2 mol<br>Trisodium citrate: 0.4 mol<br>Sodium formate: 0.5 mol<br>pH: 6.5<br>temperature: 70° C. | 610 | 813 | 1420 | 0.022 | 0.020 | 0.021 | 38.0 | 0.048 |
| 3 | Nickel sulfate (hexahydrate): 0.2 mol<br>Cobalt sulfate (heptahydrate): 0.1 mol<br>Sodium tungstate: 0.4 mol<br>Diammonium citrate: 0.4 mol<br>Oxalic acid: 0.5 mol<br>pH: 6.0<br>temperature: 70° C. | 620 | 800 | 1210 | 0.017 | 0.015 | 0.016 | W: 29.5<br>Co: 40.2 | 0.036 |
| 4 | Nickel sulfate (hexahydrate): 0.2 mol<br>Sodium tungstate: 0.1 mol<br>Diammonium citrate: 0.3 mol | 602 | 680 | 623 | 0.023 | 0.021 | 0.020 | 19.4 | 0.065 |

TABLE 1-continued

Plating solution for coating various types of tungsten alloys containing tungsten carbide and the properties of the coatings

| No. | Composition and conditions of plating solution | Hardness: Hv As plated | Hardness: Hv 400° C. × 1 hr | Hardness: Hv 700° C. × 1 hr | Wear volume by Flat Disk Revolution Wear Resistance Tester: $cm^2$ As plated | Wear volume by Flat Disk Revolution Wear Resistance Tester: $cm^2$ 400° C. × 1 hr | Wear volume by Flat Disk Revolution Wear Resistance Tester: $cm^2$ 700° C. × 1 hr | W: wt % Co: wt % | C: wt % |
|---|---|---|---|---|---|---|---|---|---|
| | Ammonium formate: 1.0 mol<br>pH: 6.5<br>temperature: 70° C. | | | | | | | | |
| 5 | Nickel sulfate (hexahydrate): 0.2 mol<br>Sodium tungstate: 0.05 mol<br>Diammonium citrate: 0.4 mol<br>Ammonium formate: 1.0 mol<br>pH: 6.5<br>temperature: 70° C. | 517 | 581 | 502 | 0.024 | 0.026 | 0.026 | 12.0 | 0.066 |

In the above table, "mol" means "molar concentrations", and Hv means vickers hardness.

Example 3

In order to investigate the corrosion resistance of the coatings under the actual atmosphere of continuous casting, the entire surface of an oxygen-free copper plate 30 mm in width, 50 mm in length, and 15 mm in thickness was coated with the following materials commonly used as the casting molds for continuous casting, each at a coating thickness of 0.8 mm: a; nickel, b; nickel-7% iron alloy plating, C; nickel-chromium thermal sprayed, d; the coating prepared from the solution No. 1 shown in Table 1, e; the coating prepared from the solution No. 2 shown in Table 1, and f; a coating prepared from the solution No. 1 shown in Table 1, except for omitting ammonium formate therefrom. The specimens thus prepared were each attached to the bottom of a casting mold for use in continuous casting, and the long-term corrosion resistance thereof was observed. The duration of exposure was 300 charges, and the evaluation was made by direct observation of the appearance and the weight loss before and after exposure tests. The results are given in Table 2. The corrosion resistance of the coating materials forcasting mold for use in continuous casting according to the present invention was found to be excellent when exposed to the atmosphere of practical continuous casting.

TABLE 2

Corrosion resistance of various coating materials

| No. | Test specimen evaluated | Corrosion loss: $g/cm^3 \times 10^{-4}$ | Appearance |
|---|---|---|---|
| a | Nickel plating | 2.7 | Discolored to gray |
| b | Nickel-7% iron alloy plating | 3.1 | ditto |
| c | Nickel-chromium spray coating | 2.3 | Changed black with etched pits |
| d | Nickel-30% tungsten alloy plating | 1.5 | Unchanged, semi-bright |
| e | Cobalt-40% tungsten alloy plating | 1.8 | Changed black |
| f | Nickel-30% tungsten alloy plating | 2.6 | Discolored to gray |

Figure 4:
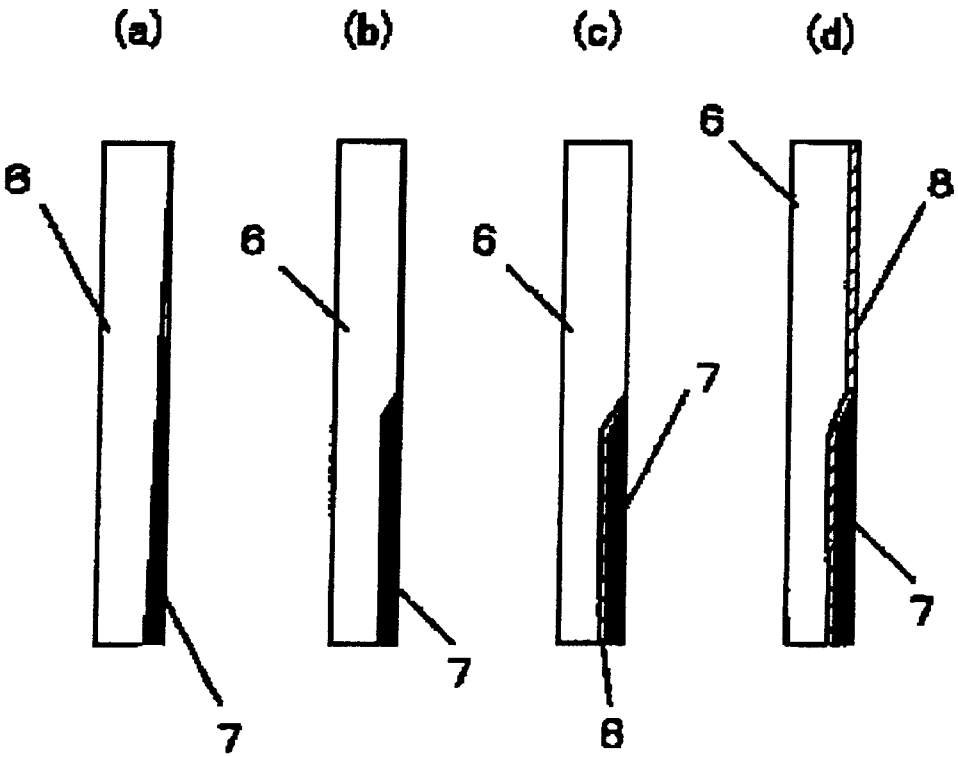
FIG. 4.

As described in the Examples above, as compared with various types of tungsten alloys known in the art, the tungsten alloy containing tungsten carbide were found to be excellent in hardness at the practically attaining temperature (hot hardness), as well as in wear resistance and corrosion resistance. The alloys above were applied to a short side of the casting mold for producing slabs, and, as compared with the nickel-chromium thermal sprayed, which has the best durability of 3,000 charges, the nickel-30% tungsten alloy containing tungsten carbide is still under use exceeding 6,000 charges. When applying to another short casting mold of a continuous casting machine, there occurred a case of generating heat cracks at only 600 charges, thereby ending the life due to the corrosion which occurred in the copper material of the casting mold for continuous casting through the heat cracks. However, the reason for this is ascribed to the few disadvantages of the tungsten alloy containing tungsten carbide according to the present invention, more specifically, to the low elongation. A coating of nickel, which is higher in corrosion resistance as compared with copper and having a higher elongation, or a nickel-iron alloy, which yields a high tensile strength and moderate elongation, provided between the tungsten alloy according to the present invention and the base material, i.e., copper or a copper alloy, has been found as a means to overcome the problem above. The symbols a to d shown in FIG. 4 show the examples in which the coating materials according to the present invention are applied. In the figure, numeral 6 corresponds to copper or a copper alloy constituting the body of the casting mold, numeral 7 corresponds to the tungsten alloy containing tungsten carbide coating the lower portion of the inside of the casting mold, and 8 is nickel or a nickel-iron alloy provided as the undercoating.

What is claimed is:

1. A casting mold for use in continuous casting of steel, wherein said casting mold comprises a body made from copper or copper alloy and having a surface for contact with molten steel which surface is partly or wholly covered with tungsten alloy plating comprising tungsten and either or both of nickel and cobalt, and said plating further comprising tungsten carbide in the tungsten alloy.

2. The casting mold as claimed in claim 1, wherein the tungsten alloy comprises from 0 to 60% by weight of cobalt and from 1 to 40% by weight of tungsten as components of the alloy along with nickel, and the plating is provided at a thickness of from 0.10 to 2.00 mm.

3. The casting mold as claimed in claim 1, wherein a nickel or a nickel-iron alloy coating is provided between the tungsten alloy plating of claim 1 and the casting mold body.

4. The casting mold as claimed in claim 2, wherein a nickel or a nickel-iron alloy coating is provided between the tungsten alloy plating of claim 2 and the casting mold body.

5. A method for producing a casting mold for use in continuous casting of steel, the casting mold comprising a body made from copper or a copper alloy and having a surface for contact with molten steel which surface is partly or wholly covered with a tungsten alloy plating comprising tungsten and either or both of nickel and cobalt, and said plating further comprising tungsten carbide in the tungsten alloy, which method comprises electroplating, either partly or wholly, the surface of the casting mold body to be brought into contact with molten steel using an electroplating solution comprising a tungstate, either or both of a nickel salt and a cobalt salt, at least one oxycarboxylic acid or a salt thereof, and at least one organic compound having two or less of carbon atoms within the molecule or a salt thereof, provided that the oxidation decomposition potential of the organic compound or the salt thereof is lower than that of the oxycarboxylic acid or the salt thereof.

6. The method as claimed in claim 5, wherein the oxycarboxylic acid is citric acid, tartaric acid, of an ammonium salt, a sodium salt or a potassium salt thereof; and wherein the organic compound is selected from the group consisting of methanol, formaldehyde, formic acid, ammonium formate, nickel formate, sodium formate, oxalic acid, ammonium oxalate, potassium oxalate, or a salt thereof.

7. The method as claimed in claim 5, wherein the electroplating solution contains an oxycarboxylic acid or a salt thereof at a concentration of 0.5 times or higher of the molar concentration of the total concentration of nickel, cobalt, and tungsten, and contains the organic compound or the salt thereof at a molar concentration of 0.1 to 3.0.

8. The method as claimed in claim 6, wherein the electroplating solution contains an oxycarboxylic acid or a salt thereof at a concentration of 0.5 times or higher of the molar concentration of the total concentration of nickel, cobalt, and tungsten, and contains the organic compound or the salt thereof at a molar concentration of 0.1 to 3.0.

* * * * *